United States Patent [19]

Agner et al.

[11] Patent Number: 4,841,840

[45] Date of Patent: Jun. 27, 1989

[54] FIRING MECHANISM FOR A SEMI-AUTOMATIC ARM

[76] Inventors: Bent Agner, Tyrolgade 1; Kaj Balsborg, Erantisvej 12, both of DK-2300 Copenhagen, Denmark

[21] Appl. No.: 41,345

[22] Filed: Apr. 22, 1987

[51] Int. Cl.[4] ..... F41D 11/16

[52] U.S. Cl. ..... 89/154; 42/70.08

[58] Field of Search ..... 89/136, 147, 150, 154, 89/179; 42/70.08

[56] References Cited

U.S. PATENT DOCUMENTS

| | | | |
|---|---|---|---|
| 1,096,615 | 5/1914 | Febiger | 89/154 |
| 2,286,133 | 6/1942 | Williams | 89/179 |
| 3,942,278 | 3/1976 | Schaller et al. . | |
| 4,090,316 | 5/1978 | Volkmar | 42/70.08 |
| 4,522,106 | 6/1985 | Sullivan . | |

FOREIGN PATENT DOCUMENTS

| | | | |
|---|---|---|---|
| 692741 | 6/1940 | Fed. Rep. of Germany | 42/70.08 |
| 2480928 | 10/1981 | France | 42/70.08 |
| 278022 | 1/1952 | Switzerland | 89/154 |

*Primary Examiner*—Deborah L. Kyle
*Assistant Examiner*—Stephen Johnson
*Attorney, Agent, or Firm*—Scully, Scott, Murphy & Presser

[57] ABSTRACT

The firing pin (17) of a semi-automatic arm is so adapted and arranged in a firing pin chamber (15) that, in addition to being movable axially between a neutral position and a striking position under the action of a hammer (34), said firing pin is movable between an inactive position in which the striking end (25) is staggered radially with respect to the percussion cap of a cartridge (15) inserted in the firing chamber, and an active position in which the striking end is positioned axially in line with the percussion cap. This movement is produced by a trigger actuated trigger bar (35, 36) which releases the hammer after having actuated the firing pin. Since firing can take place only when the firing pin has been caused to assume the active position under the action of the trigger, the arm has a very high degree of safety against unintentional firing.

8 Claims, 4 Drawing Sheets

FIRING MECHANISM FOR A SEMI-AUTOMATIC ARM

BACKGROUND OF THE INVENTION

The invention relates to a firing mechanism for a semiautomatic arm having a firing pin chamber disposed in elongation of a firing chamber, a firing pin being axially movable in said firing pin chamber between a neutral position in which its striking end is disposed in axial distance from a cartridge placed in the firing chamber, and a striking position in which the striking end is in contact with the percussion cap of the cartridge, means being provided to activate a trigger and thereby move the firing pin from the neutral position to the striking position.

DISCUSSION OF THE PRIOR ART

In the known firing mechanisms of this type, the firing pin is usually a horizontal steel pin positioned axially adjacent the percussion cap of a cartridge in the firing chamber. This structure of the firing mechanism involves the risk of the firing pin striking the percussion cap without activation of the trigger, e.g. because of impacts caused by dropping or throwing of the weapon. Also wear or defects in the mechanical parts may cause unintentional firing.

SUMMARY OF THE INVENTION

The object of the invention is to provide a firing mechanism of the present type which improves both the passive safety, i.e. safety against unintentional firing of a loaded arm when not in use for its intended purpose, and the active safety, i.e. safety against misfiring during shooting with the arm.

This object is achieved in that the firing pin is so adapted and arranged that its striking end is additionally movable in a radial direction between an inactive position in which it is disposed radially outside the percussion cap area of the cartridge, and an active position in which it is disposed radially within said area, control means being provided to move the striking end of the firing pin from its inactive to its active position upon actuation of the trigger. This structure of the firing mechanism entails that the firing pin will always, except when the trigger is activated, be in an inactive position in which its striking end is staggered with respect to the percussion cap area, so that the risk of external influences causing firing is practically non-existent. This is true no matter whether the hammer is cocked, and even if a cocked hammer should strike the firing pin because of defects in mechanical parts, no firing will take place.

Claim 2 defines an embodiment of the firing mechanism in which the trigger bar serving to activate the hammer can also be used for bringing the firing pin into the active position, and claims 3–7 define expedient details in the firing mechanism.

An arm in which the firing mechanism of the invention is mounted may additionally be equipped with a manual safety system, which may be arranged as stated in claim 8.

In practice, the firing mechanism of the invention is preferably used in connection with a pistol of the type having a slide which is moved rearwardly by the force of recoil and thus automatically cocks the hammer, and since the pistol can be carried with cocked hammer without any risk of unintentional firing, it is manufactured as a so-called single action pistol where the hammer is cocked manually before the first shot. In double action arms the hammer is cocked at the first shot by pulling the trigger, which requires a force of several kilos. The accuracy is therefore very poor, and the risk of misses is great. The purpose of double action is to enable quick firing without prior cocking of the hammer. The alternative would be to carry the arm with cocked hammer, which involves a great risk of accidental shots, firing because of defects in material, impacts, loss of the arm, etc. Thus, it is a great advantage of the firing mechanism of the invention that the passive safety obtained makes double action superfluous.

BRIEF DESCRIPTION OF THE DRAWINGS

The invention will be explained more fully below with reference to the drawings in which.

DESCRIPTION OF THE PREFERRED EMBODIMENT

Figure 1:
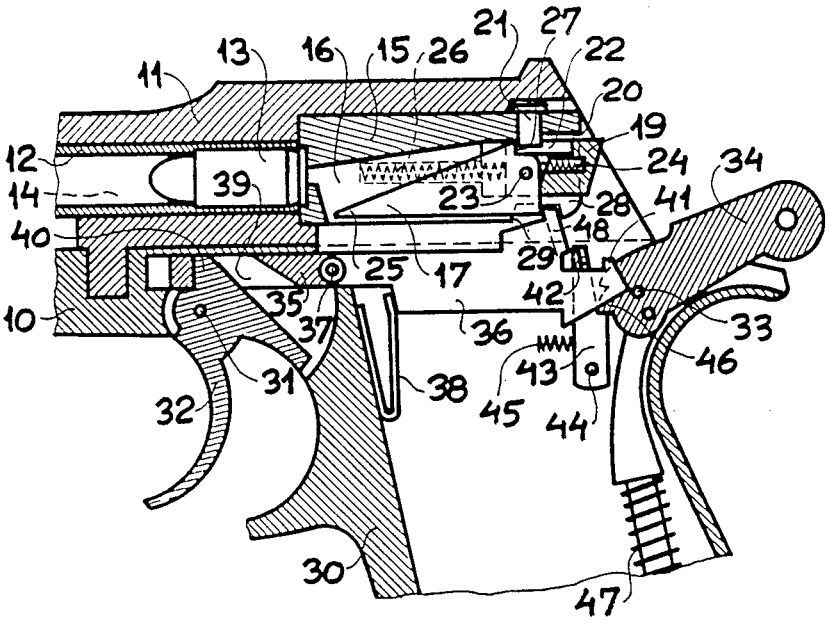
FIG. 1 is vertical section through a part of a pistol with an embodiment of the firing mechanism of the invention.

In the drawing, 10 is a pistol frame with a barrel section 11 containing a rifled barrel 12. A cartridge 13 is shown inserted in a firing chamber at the rear end of the barrel. A slide, slidably movable on the frame, has two side members 14, which extend substantially in the entire length of the pistol at their respective sides of the barrel section, and which are rearwardly interconnected by a firing pin section 15, whose front face in one extreme position of the section, shown in FIG. 1, engages the rear end of the firing chamber and is formed with a recess to receive the bottom flange of the cartridge. The firing pin section 15, which is shown more clearly in FIGS. 5 and 6, defines a firing pin chamber 16 containing a plate-shaped substantially triangular firing pin 17 with a forwardly directed tip which forms the striking end 25. The rear end of the firing pin 17 is disposed in a vertical slot 18 in the front end of a cylindrical carrier 19 slidable a limited distance in a channel 20 in the rear end of the section 15. The axial movements of the carrier 19 are limited by engagement of a screw nipple 21 in the section 15 with the edges of a flat recess 22 in the upper side of the carrier. A transverse pin 23 rotatably connects the firing pin with the carrier, and a compression spiral spring 24, disposed in an axial channel in the carrier, urges the firing pin to assume the position shown in FIGS. 1 and 5, in which the striking end 25 is staggered with respect the cartridge 13, and which is determined in that the rear end of the firing pin engages the lower, rear edge of the slot 18. A compression spiral spring 26, disposed in a channel in the section 15, urges the carrier 19 rearwardly. A notch in the upper, rear shoulder of the firing pin 17 forms a shoulder 27 which, in the position shown in FIG. 5, engages the screw nipple 21 under the action of the pressure from the spring 26. This pressure is instrumental in keeping the firing pin in the angular position shown in FIG. 5.

As will be seen, the firing pin chamber 16 is formed by a vertical slot in the section 15. The lower portion of this slot is present between two rails 28 extending downwardly from the underside of the section. Adjacent the rear end, these rails are formed with a low recess 29 with inclined end edges. In the FIG. 5 position of the parts, these recesses extend a distance at both sides of the rear edge of the firing pin 17.

As shown in FIGS. 1–4, the pistol has a trigger 32 pivotable about a pin 31 and a hammer 34 pivotable about a pin 33. A trigger bar, consisting of two links 35 and 36 interconnected by a pivot 37, is slidably mounted in the frame. A folded leaf 38, fixed between a frame part 30 and a shoulder on the link 36, affects the trigger bar with a rearwardly directed force and keeps the front edge 40 on the trigger. The rear end of the link 36 has an upwardly directed catch hook 41 disposed, in the fig. 1 position, a distance behind a lateral projection 42 on a sear 43, which is formed with a pawl tooth and is pivotable about a pin 44, and which is kept in pawl engagement with a tooth 46 on the hammer 34 by a spring 45 in the position shown in FIG. 1, said hammer 34 being thereby cocked against the action of a hammer spring 47 placed in the frame part 30.

The trigger bar link 36 is additionally formed with an upwardly extending, perpendicularly bent projection 48, which extends laterally below the rails 28 on the firing pin section 15 and engages, in the FIG. 1 position, behind the lower portion of the rear edge of the firing pin 17.

Figure 2:
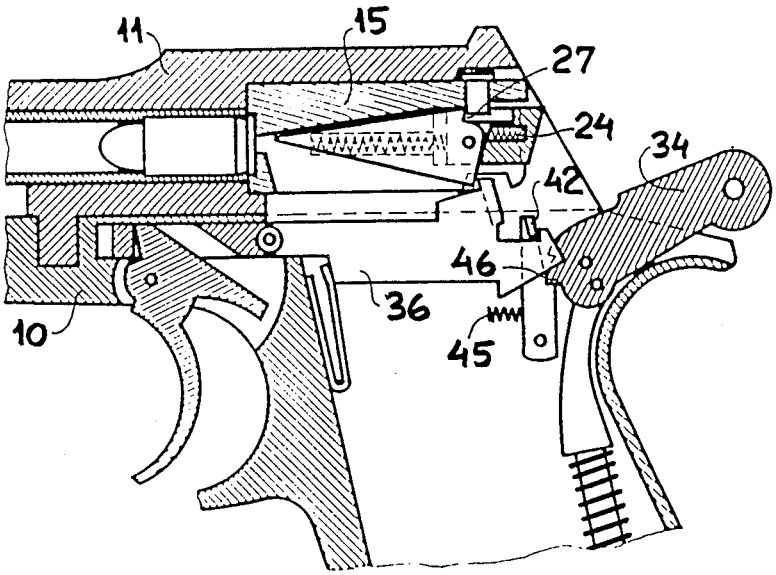
FIGS. 2, 3 and 4 show the firing mechanism in various working positions.

FIG. 1 shows the pistol in a position ready for shooting with a cartridge in the chamber and the hammer cocked, which may have been done by manual retraction of the slide 14, 15. The firing pin 17 is in an inactive position, and the trigger 32 is unaffected. FIG. 2 shows the positions of the parts after initial activation of the trigger, the trigger bar 35, 36 having been pulled so far forwardly that the projection 48 has pivoted the firing pin by pressure against its rear edge up into the shown active position in which its striking tip 25 is positioned adjacent the percussion cap of the cartridge. This movement of the trigger bar has caused the catch hook 41 to engage the projection 42 on the sear 43 without affecting the sear.

Figure 3:
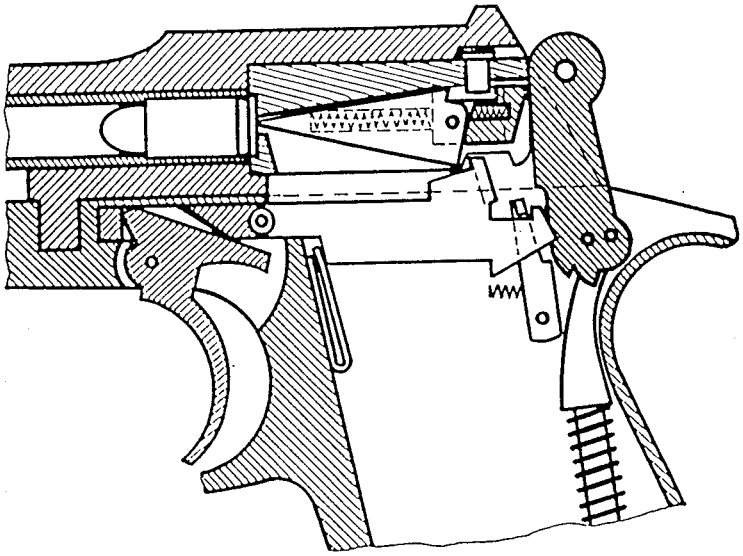
Figure 5:
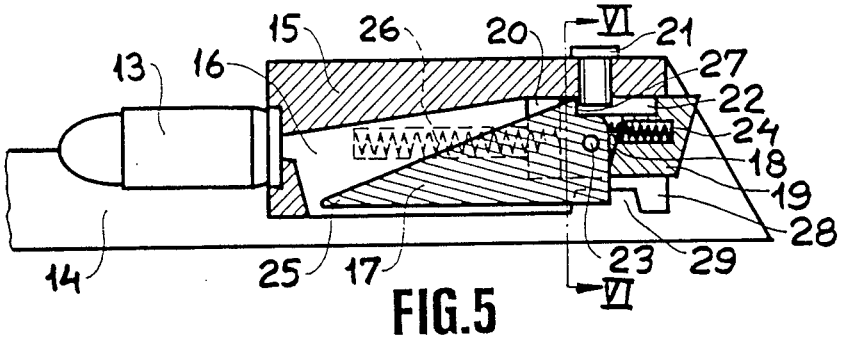
FIG. 5 is an enlarged vertical section through the firing mechanism.
Figure 6:
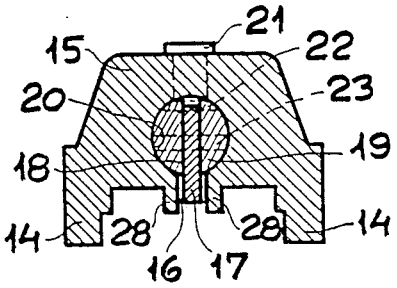
FIG. 6 is a cross-section along the line VI—VI in FIG. 5.

Upon additional, relatively short trigger travel, the catch hook 41 will pull the sear 43 out of engagement with the hammer tooth 46 so that the hammer 34 is released and caused to engage the carrier 19 by the hammer spring 47. This accelerates the firing pin 17 toward the percussion cap of the cartridge and causes the cartridge to be fired. During advance of the firing pin, its lower rear edge is caused to be flush with or has just passed the inclined front edge of the recesses 29 in the rails 28 (FIG. 5). This situation is shown in FIG. 3.

Figure 4:
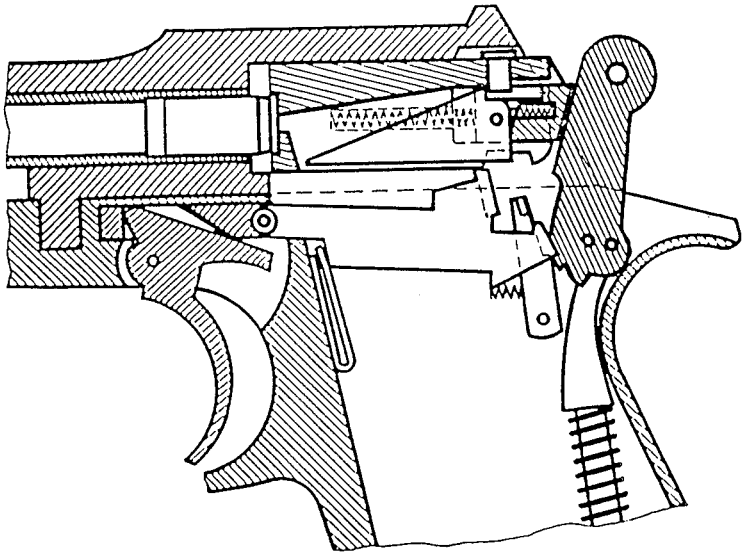

In FIG. 4, the situation is shown immediately after firing has taken place and the slide 14, 15 has initiated its recoil movement. The inclined front edge on the recess 29 of the rails 28 has by cam action pressed the trigger bar link 36 downwardly against the action of the spring 38, so that the projection 48 has been engaged with the underside of the rails 28 with consequent release of the firing pin 17 and return of it to its inactive position. The catch hook 41 of the trigger bar has at the same time been moved down below the transverse projection 42 of the sear 43. After just about 1/100 of a second the empty case has left the firing chamber and been ejected and a new cartridge been inserted from a magazine (not shown) in the frame part 30.

These functions take place through the aid of generally known means (not shown). Of course, firing and recoil movement take place so rapidly that the shooter does not manage to release the trigger. Since, however, the sear 43 is released and keeps the hammer 34 in the cocked position which it has been caused to assume by the slide during the recoil movement thereof, the hammer cannot be reactivated until the trigger has been released and thus made it possible for the spring 38 to move the trigger bar and projection 48 of the catch hook 41 into engaged position with respect to the sear projection 42 and the firing pin 17, respectively. After completion of the recoil stroke and a recoil spring (not shown) has conventionally moved the slide to its starting position, and after release of the trigger, the parts are again in the positions shown in FIG. 1, ready for firing of a new shot.

Figure 7:
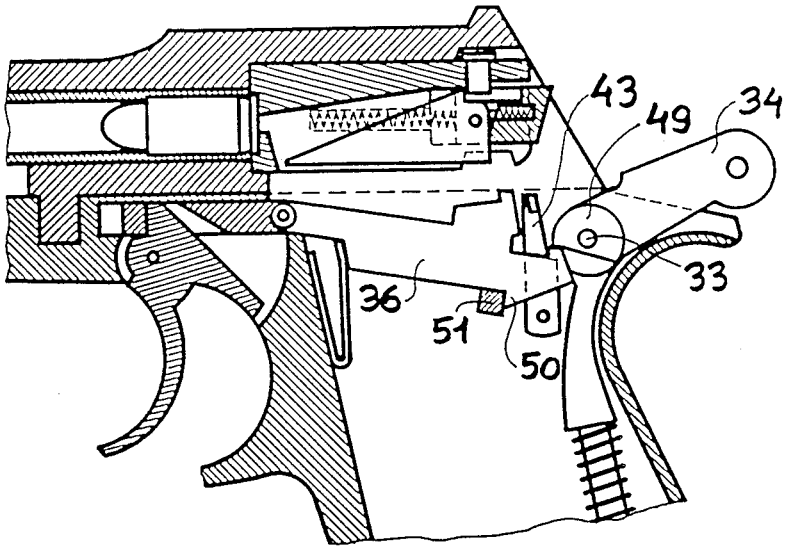
FIG. 7 is a vertical section corresponding to those of FIGS. 1–4 through a part of a pistol equipped with a manual safety system.

In FIG. 7, the firing mechanism described above is supplemented with a manual safety system. This is formed by a semi-cylindrical collar 49 pivotable about the axis of rotation of the hammer by means of an operating arm (not shown), so that the collar may be caused to press the trigger bar link down into an inactive position in which a hook 50 on said link engages behind a hook 51 provided in the frame part 30, with the result that trigger, trigger bar as well as hammer are blocked.

Figure 8:
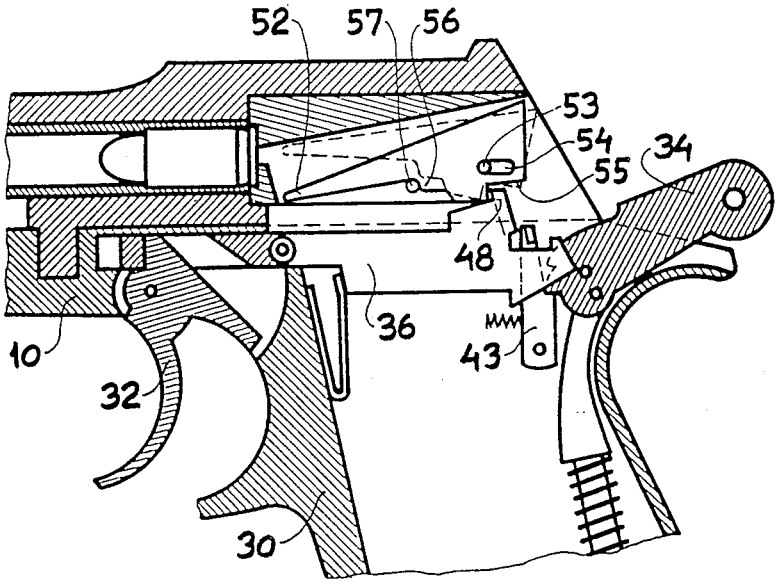
FIG. 8 is a vertical section through a part of a pistol with another embodiment of the mechanism of the invention.

The embodiment defined in FIG. 8 differs from the one described above in that it does not have a separate carrier, the firing pin, here designated by 52, being so constructed and arranged that its rear end can be hit directly by the hammer 34. The firing pin 52 is carried by a transverse pin 53 extending through a substantially horizontal slot 54 in the firing pin adjacent its rear end. Springs (not shown) urge the firing pin rearwardly and pivot the striking end downwardly, i.e. to the position shown in solid line in FIG. 8. The firing pin has a cut 55 at its lower rear edge and the front edge of said cut is affected by the projection 48 on the trigger bar link 36 when this link is advanced upon activation of the trigger. The lower edge of the firing pin is provided with a shoulder 56 forming an inclined cam edge which cooperates with a fixed transverse pin 57 to move the firing pin up into the striking position shown in dashed lines when the trigger bar moves the firing pin forwardly. During the striking movement generated by the hammer 34, the slot 54 slides across the pin 53. Otherwise, the firing mechanism operates in the same manner as described above in connection with FIGS. 1–7. The rear portion of the firing pin may be formed as a block of rectangular cross-section.

The details of the firing mechanism described, e.g. the structure and arrangement of the firing pin and the means through which the firing pin is affected from the trigger bar, may be modified in many ways within the scope of the invention.

We claim:

1. A firing mechanism for a semi-automatic arm comprising a firing chamber for discharging a cartridge positioned in said firing chamber, a firing pin chamber forming an elongation of said firing chamber, a firing pin including a striking end for striking a percussion cap of said cartridge to discharge said cartridge, and means to activate a trigger and thereby move said firing pin to discharge said cartridge, said striking end of said firing pin being adjacent said firing chamber, wherein said firing pin is pivotable in a radial direction between an inactive position in which said striking end is radially outside of a cylinder defined by walls of a barrel of said semi-automatic arm of said cartridge and an active position in which said striking end is radially inside said cylinder, said firing pin being additionally movable in a substantially axial direction from a neutral position in which said striking end is axially offset from said percussion cap to a striking position in which said striking end contacts said percussion cap to discharge said cartridge.

2. A firing mechanism according to claim 1, comprising a spring-loaded hammer which is adapted to engage the firing pin and which can be maintained in a cocked position by means of a sear, and comprising a trigger bar adapted to disengage the sear from the hammer upon actuation of the trigger, wherein the trigger bar is additionally adapted to act as a control means for the firing pin.

3. A firing mechanism according to claim 2, wherein adjacent a rear end of the firing pin is pivotally connected with an axially movable carrier and is urged to assume said inactive position, and that the firing pin and the trigger bar have cooperating parts adapted to pivot the firing pin up into said active position upon movement of the trigger bar.

4. A firing mechanism according to claim 3, and in which at least a rear portion of the trigger bar is movable in a vertical plane and is affected by a spring in an upward direction, wherein said cooperating parts are formed by a downwardly extending part in a vicinity of the rear end of the firing pin and an upwardly extending trigger bar projection to engage with said downwardly extending part behind a lower end of said downwardly extending part.

5. A firing mechanism according to claim 4, in which the firing pin chamber, which contains the firing pin and the axially movable carrier, forms part of a slide which is moved rearwards by a force of recoil from a fired cartridge, wherein the firing pin chamber is downwardly formed with a cam face cooperating with the trigger bar projection such that said projection is pressed down below said firing pin portion during the recoil movement.

6. A firing mechanism according to claim 5, wherein the carrier is spring-loaded to move rearwardly in the firing pin chamber, and that stop means are provided in said chamber to limit the axial movements of the carrier.

7. A firing mechanism according to claim 6, wherein the carrier is cylindrical, and that the firing pin is formed by a substantially triangular plate whose rear, upper portion is disposed in a vertical slot in a front end of the carrier and connected with said carrier by a transverse pivot, and that the rear end of the firing pin is affected by a spring, disposed in a recess in the carrier, for rotation in a direction toward the inactive position of the striking end.

8. A firing mechanism according to any of claims 4–7 wherein a safety means is provided for moving a trigger bar part in a vertical plane to a position in which said trigger bar part can neither affect the sear nor the firing pin, and in which position a hook provided on said trigger bar part engages behind a fixed hood and thereby prevents forward movement of the trigger bar.

* * * * *